US005849408A

United States Patent [19]

Sugawara

[11] Patent Number: 5,849,408

[45] **Date of Patent: *Dec. 15, 1998**

[54] HOT-DIP ZINC PLATING PRODUCT

[75] Inventor: Noriaki Sugawara, Toyama, Japan

[73] Assignee: Nippon Mining & Metals Co., Ltd., Tokyo, Japan

[ * ] Notice: The term of this patent shall not extend beyond the expiration date of Pat. No. 5,529,810.

[21] Appl. No.: 665,348

[22] Filed: Jun. 17, 1996

Related U.S. Application Data

[63] Continuation-in-part of Ser. No. 337,381, Nov. 8, 1994, Pat. No. 5,529,810.

[30] Foreign Application Priority Data

Dec. 27, 1993 [JP] Japan ..... 5-346893

[51] Int. Cl.[6] ..... B32B 15/00; B32B 15/18; B32B 15/20; B05D 1/18

[52] U.S. Cl. ..... 428/332; 428/650; 428/659; 428/681; 427/433; 427/436

[58] Field of Search ..... 428/638, 658, 428/681, 682, 615, 332, 650, 683, 684, 685, 659; 420/514; 427/433, 436

[56] References Cited

U.S. PATENT DOCUMENTS

| | | | |
|---|---|---|---|
| 4,605,598 | 8/1986 | Thomas et al. | 428/659 |
| 4,636,354 | 1/1987 | Caillerie et al. | 420/514 |
| 4,792,499 | 12/1988 | Shindou et al. | 428/659 |
| 4,812,371 | 3/1989 | Shindou et al. | 428/659 |
| 5,091,150 | 2/1992 | Memmi et al. | 420/541 |
| 5,141,781 | 8/1992 | Suzuki et al. | 427/398.1 |
| 5,312,531 | 5/1994 | Nishimura et al. | 204/206 |
| 5,326,648 | 7/1994 | Kato et al. | 428/610 |
| 5,529,810 | 6/1996 | Sugawara | 427/433 |

FOREIGN PATENT DOCUMENTS

| | | |
|---|---|---|
| 61-201767 | 9/1986 | Japan . |
| 419299B2 | 3/1992 | Japan . |

*Primary Examiner*—John J. Zimmerman
*Assistant Examiner*—Michael LaVilla
*Attorney, Agent, or Firm*—Kubovcik & Kubovcik

[57] ABSTRACT

When a hot-dip zinc plating layer, which contains Al, is applied on rimmed steel having an Si level of less than 0.05% by weight or less, by the two-stage plating method, appearance failure can be prevented by setting the plating conditions as follows: in a first zinc bath consisting of zinc of 99.7% purity or more or in a second zinc bath which consists of zinc with 99.7% purity by weight or more and 0.05% or less of Al at a temperature of from more than 460° C. to 490° C. and for a dipping time of from 1 minute to 1.5 minutes; and, in a second zinc bath consisting of zinc of 99.7% purity by weight and from 2 to 10% by weight or less of Al at a temperature of from 400° C. to less than 430° C. and for a dipping time of from 0.5 minute to 1.5 minutes. This plating condition provides a plating structure that the Zn, Fe and Al are present in the essentially entire portion of the plating layer. The Zn-centration increases in the direction from the boundary to the top of said layer; the Al concentration decreases in the direction from the boundary to the top of said layer.

3 Claims, 6 Drawing Sheets

HOT-DIP ZINC PLATING PRODUCT

This is a continuation-in-part application of U.S. Ser. No. 08/337,381 filed on 08 Nov. 1994, now U.S. Pat. No. 5,529,810.

BACKGROUND OF INVENTION

1. Field of Invention

The present invention relates to a rimmed steel, on which a hot-dip zinc plating layer containing Al is provided. The rimmed steel herein is not at all limited by its application and includes, for example, use for general construction, sheet material, plate material and the like. Furthermore, the usual components of the rimmed steel other than Si are 0.3% or less of C and 0.50% or less of Mn.

More specifically, the present invention relates to an improvement of a two-stage hot-dip zinc plated product, such that no failure in appearance occurs on the rimmed steel and the corrosion-resistance of hot-dip plating coating is improved.

2. Description of Related Arts

Heretofore, the general method for improving the corrosion-resistance of hot-dip zinc plated steel has been to increase the coating weight of the plating. In order to increase the coating weight of the plating, pre-treatment prior to the plating may be carried out by subjecting the steel to blasting. Alternatively, the dipping time in a fused zinc bath may be extended. In each case, it is intended to develop the Fe—Zn alloy layer and hence to increase the coating weight of the plating. Nevertheless, improvement of the corrosion-resistance falls short of expectation. Furthermore, the Fe—Zn layer may develop up to the surface of the coating layer, so that a phenomenon referred to as "yellowing" occurs, which impairs the plating appearance and commercial value of the plated products.

In recent years, not only in the field of continuous hot-dip zinc galvanizing of a strip but also in hot-dip galvanizing of cut sheets, an Al—Zn alloy bath, which is a Zn bath with the addition of Al, has been used to suppress the formation of the Fe—Zn alloy layer and also to improve corrosion resistance. When a conventional flux is used, a preferential reaction occurs between the aluminum of the Zn—Al alloy bath and Cl of the flux, with the result that the alloying reaction between the steel and Al—Zn is impeded, thereby generating a phenomenon referred to as the "non-plating".

In order to solve the above described problems, Japanese Unexamined Patent Publication No. Sho 60-125,361, Japanese Examined Patent Publication No. Hei 01-5,110, and Japanese Unexamined Patent Publication No. Hei 03-100, 151 propose a special flux which does not impede the formation of an Al—Zn alloy plating.

Japanese Unexamined Patent Publication No. Sho 53-47, 055 and Japanese Unexamined Patent Publication No. Hei 05-106,002 propose to add a third element to the Al—Zn alloy bath so as to form an Al—Zn alloy plating by a single dipping.

Japanese Unexamined Patent Publication No. Sho 61-201,767 proposes to form a plating coating by means of hot dipping in a Zn bath without the addition of Al and then to supply Al into the plating coating by means of dipping in an Al—Zn alloy bath. According to this method, the Al—Zn alloy plating layer can be formed thinly by a two-stage plating method. In an example of the above Japanese Unexamined Patent Publication No. Sho 61-201,767, the plating is applied on steel for constructional use (SS41 corresponding to ISO Standard SS400).

Heretofore, the steel material, on which the Al—Zn alloy plating is applied, is not specified in most of the Japanese patent applications, although it may occasionally be specified such as high-tensile steel is in Scope of Claim for Patent (Japanese Unexamined Patent Publication No. Hei 04-311, 553) or in Examples (for example, in Japanese Unexamined Patent Publication No. Hei 05-106,002, or SPCC in Japanese Unexamined Patent Publication No. 53-47,055).

Previously, hot-dip zinc plating was considered to be applicable to either rimmed steel, semi-killed steel or killed steel ("The Making, Shaping and Treating of Steel", edited by United Steel Corporation, pages 356 and 357 of the Japanese Translation, second edition, third printing). U.S. Patent No. 5,141,781 discloses a successive hot-dip galvanizing method: the first step (zinc plating at 430°–480° C.); the second step (air cooling to attain growth of a 70 $\mu$m or more thick zeta layer); and, the third step (plating in a zinc bath containing from 0.1 to 10% of Al at a temperature of from 390° to 450° C).

In the first step, the delta layer and the zeta layer are formed on the metal article. In the second step, the zeta layer is caused to grow. The thickness of the combined plating layer is preferably at least 100 $\mu$m thick. The time, temperature and concentration are preferably selected so that the total plating thickness obtained is at least 100 $\mu$m.

Regarding materials to be treated, steel, ductile cast iron (FCD 40), hot-rolled sheet steel (SS400, SS41), normal cast iron and malleable cast iron (FCMB) are mentioned.

SUMMARY OF INVENTION

The present inventors carried out Al—Zn alloy plating on steel materials in a commercial-scale plant relying on known, two-stage methods and methods of adding a third element. It turned out that appearance failures, which have not occurred in the case of an experimental, small-size plating plant, were generated on the rimmed steel. Appearance failures such as rough deposits and ripple-form wrinkles were observed on the entire alloy-plating coating formed on the steel material. Another appearance failure is a defect in the plating coating where the thickness of the plating coating decreases drastically. The commercial value of the plated product is impaired when any one of such appearance failures occurs.

Because of the reasons as described above, a hot-dip Al—Zn plating coating with improved corrosion-resistance, could not be successfully applied on the rimmed steel. The plating manufacturers took countermeasures, therefore, with application of ordinary hot-dip zinc plating with corrosion-resistance property inferior to that of the Al—Zn alloy plating.

It is, therefore, an object of the present invention to provide a hot-dip zinc plated rimmed steel which can attain corrosion-resistance at least five times as high as that of the current hot-dip zinc plating and in which no appearance failure occurs.

In accordance with the objects of the present invention there is provided a hot-dip zinc plated steel, comprising:

a rimmed steel having an Si content of less than 0.05% by weight; and, a hot-dip zinc plating layer formed by successive two-stage hot-dip Zn—Al galvanizing and consisting of a Zn—Al—Fe layer, the composition of from which is 5 to 30% by weight of Al, not more than 20% by weight of Fe, the balance being essentially Zn, and in which Zn, Al and Fe are present essentially in the entire portion of the Zn—Al—Fe layer.

DESCRIPTION OF PREFERRED EMBODIMENTS

A method for producing the hot-dip-zinc plating method is first described.

The first hot-dip zinc plating step is first described.

Purity of the zinc in the plating bath is 99.7% by weight or more, because at a purity less than this value the desired corrosion-resistance is not obtained. For example, the purest zinc metal, electric zinc metal, distilled zinc metal obtained by a double condensing method and the like can be used for preparing the zinc plating bath. Al may or may not be added to the zinc plating bath. Al, when added to the zinc plating bath, suppresses excessive growth of the Fe—Zn alloy layer. The addition amount of Al is 0.05% by weight or less, because Al added in a greater amount than this value results in generation of non-plating even in the first step, and no plating coating can be formed in the second step on the defective portions where the non-plating has occurred.

In addition, the bath temperature in the first plating step is 460° C. at the lowest because, at a temperature lower than this value, the plating structure does not develop sufficiently in the plating coating formed on the rimmed steel and, hence, the thickness of the plating coating is very small. Even when the second plating is applied on such thin plating corrosion-resistance cannot be expected. The bath temperature of the first plating is 490° C. at the highest because at a temperature exceeding this value, the Fe—Zn alloy layer in the plating coating undergoes structural change such that generation of appearance failure after the second plating step is accelerated. The dipping time is 1 minute at the shortest so as to obtain the necessary thickness of the Fe—Zn alloy layer as the underlying layer of the second plating coating. The dipping time is 1.5 minutes at the longest, because at a dipping time longer than this value the Fe—Zn alloy layer grows unnecessarily so that "yellowing" occurs or formability of the plated steel is impaired.

Preferable condition of the first hot-dip zinc plating is a bath temperature of from more than 460° C. to 480° C.

The second hot-dip plating step is now described.

Aluminum in an amount of 2% by weight or more is added to the fused zinc bath to enhance the corrosion-resistance of the hot-dip zinc plating layer. The addition amount of aluminum is 10% by weight at the highest, because aluminum added in a greater amount than this value raises the temperature of the plating bath and caused appearance failure.

The bath temperature in the second hot-dip plating is 400° C. at the lowest because, at a temperature lower than this value, viscosity of the bath increases to the extent that appearance failure occurs in the case of plating on rimmed steel. The bath temperature is less than 430° C. because, at a temperature higher than this value, appearance failure occurs in the case of plating on rimmed steel. More specifically, the first plating layer formed on the surface of steel having an Si content of less than 0.05% by weight has a coating structure which is somewhat different from that of a coating layer formed on steel having an Si content of 0.05% by weight or more, i.e., the so-called killed steel. In addition, the second plating layer formed on the steel having an Si content of less than 0.05% by weight has a coating structure which is somewhat different from that of a coating layer having an Si content of 0.05% by weight or more. The plating-coating structure, which is formed on steel with an Si content of less than 0.05% by weight at a temperature of 430° C. or more, is abnormal and causes the generation of appearance failure.

The dipping time is 0.5 minute at the shortest, which is the minimum reaction time necessary for forming the plating-coating structure having improved corrosion-resistance. The dipping time is 1.5 minutes at the longest, because at a dipping time longer than this value, the effects of hot-dip plating reach saturation and, occasionally, the reaction to form the coating structure exceeds the limit where good appearance can be maintained.

Preferred conditions for the second hot-dip plating are an Al content of from 4 to 8% by weight and bath temperature of from 420° C. to less than 430° C.

Incidentally, Japanese Unexamined Patent Publication No. Sho 61-201,767 filed by the present assignee discloses a method for forming a hot-dip zinc alloy plating layer in which a plating coating with improved corrosion-resistance and without appearance failure is formed on killed steel with an Si content of 0.05% by weight or more. Specifically, neither rough deposits, ripple-form wrinkles, nor deficient plating in the coating occur on the killed steel. In addition, when the inventive method is applied to form a hot-dip zinc plating coating on the killed steel, the plating coating thus formed exhibits good corrosion-resistance which is, however, inferior to that attained by the Japanese patent publication mentioned above.

The hot-dip zinc alloy plating layer having an Al content of from 5 to 30% by weight exhibits corrosion-resistance five times or more in terms of the salt-water spraying test stipulated under JIS-Z-2371 as compared with the conventional hot-dip zinc plating coating. The iron content in the hot-dip zinc alloy plating layer preferably does not exceed 20% by weight, because at an iron content greater than this value, the reaction to form the coating structure exceeds the limit where good appearance can be maintained. A more preferable iron content is from 3 to 15% by weight.

The coating thickness of hot-dip zinc plating according to the present invention is preferably from 50 to 100 um.

The hot-dip zinc plating layer is hereinafter described with reference to the drawings.

Figure 1:
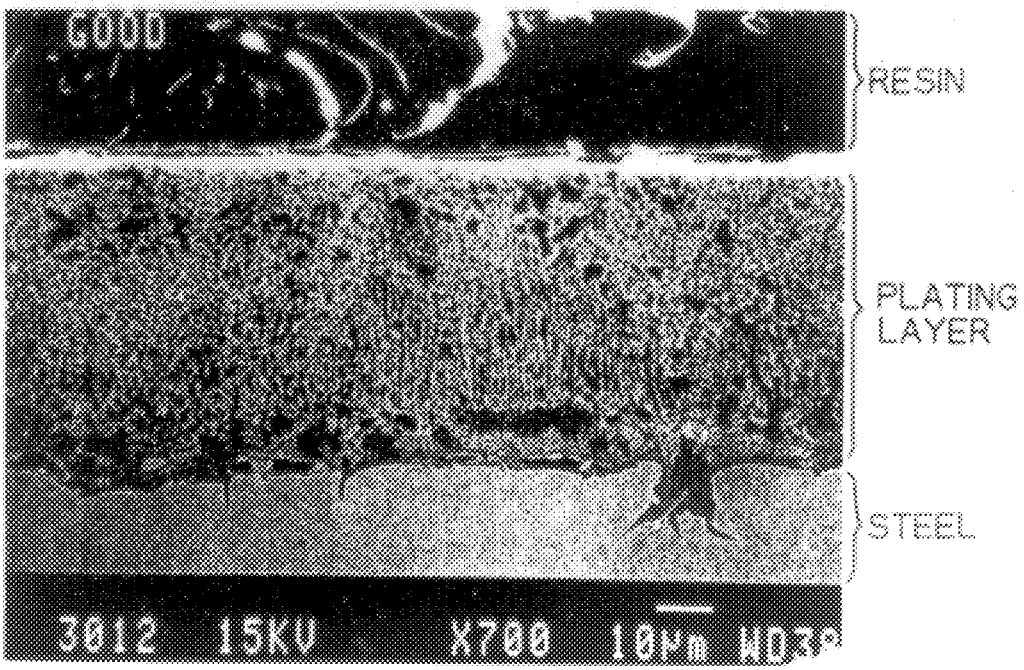
FIG. 1 is an electron microscope photograph of the hot-dip zinc plating layer according to the present invention (No. 2 of Table 1) at a magnification of 700.
Figure 3:
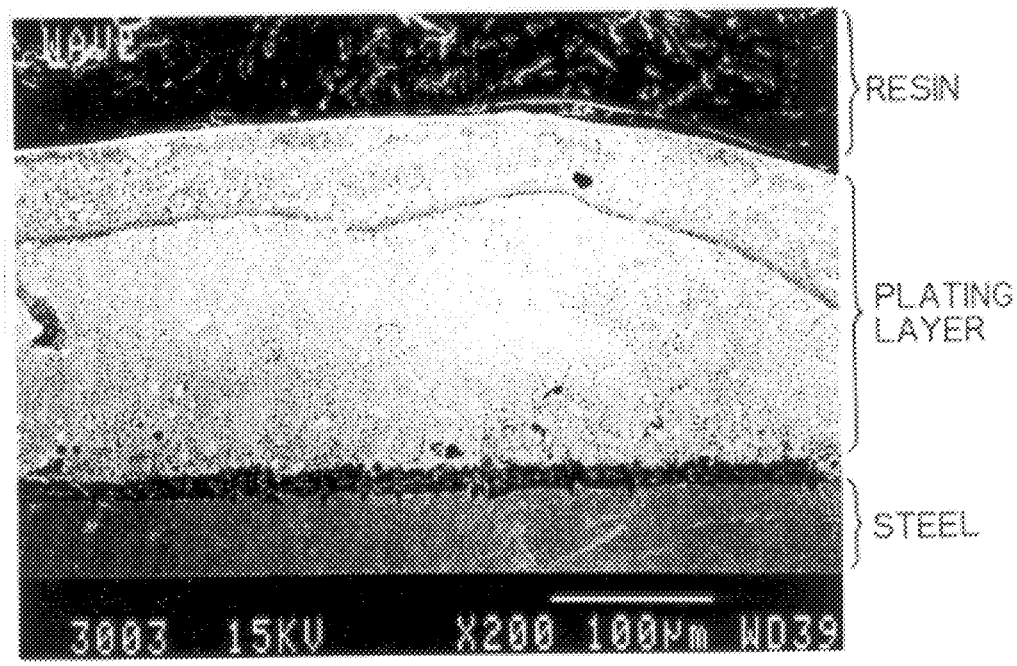
FIG. 3 is an electron microscope photograph of a hot-dip zinc plating layer on which ripple-form wrinkles are formed (No. 7 of Table 1) at magnification of 200.

The layer structure under the electron microscope observation is clearly distinct between the inventive one shown in FIG. 1 and the comparative one with one of the plating failures, i.e., the ripple-form wrinkles, in the points that three layers are apparent in FIG. 3, but no layer-boundary is apparent in FIG. 1.

Figure 2:
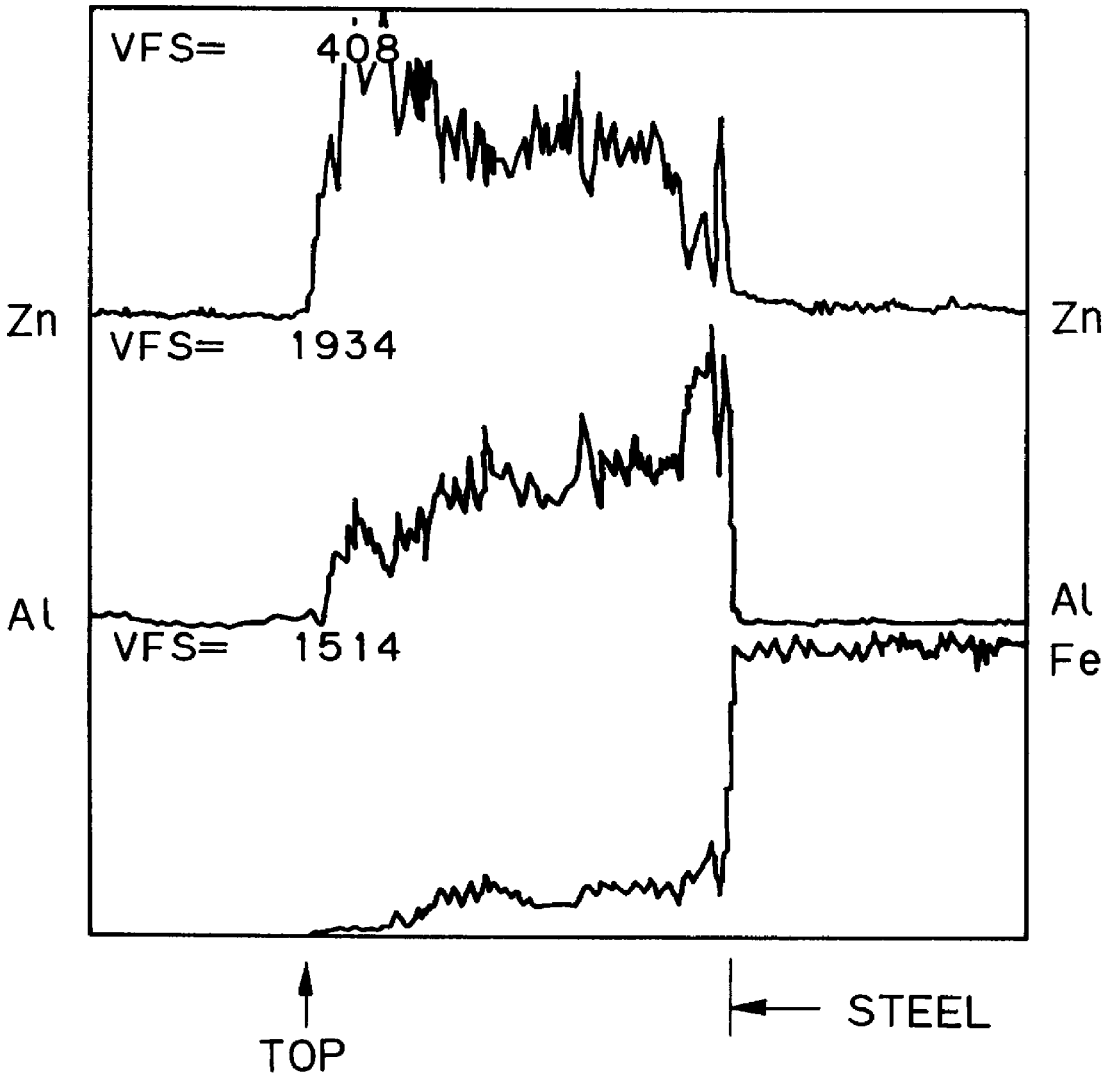
FIG. 2 is an X-ray microprobe analyzing chart of the hot-dip zinc plating layer of FIG. 1.
Figure 4:
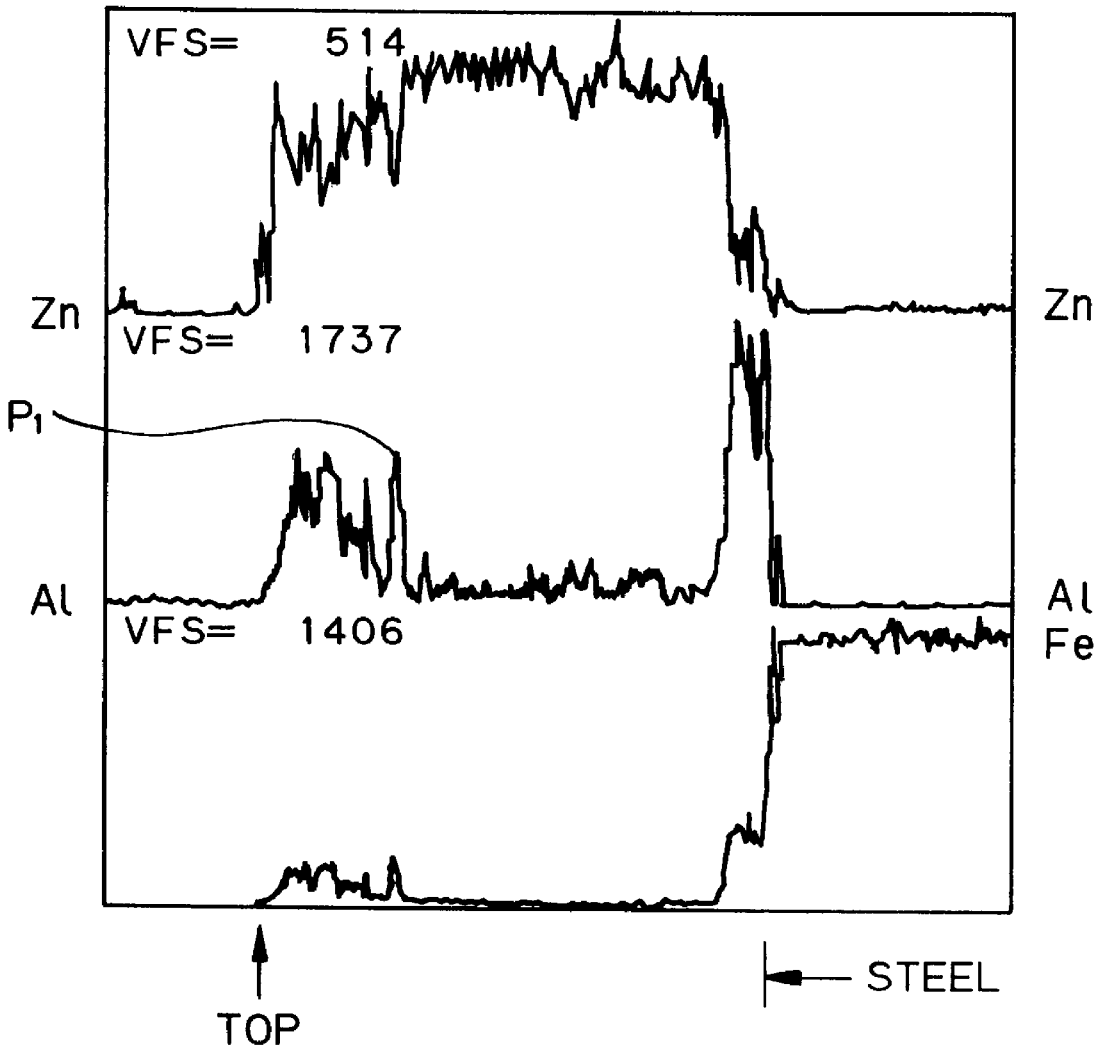
FIG. 4 is an X-ray microscope analytical chart of the hot-dip zinc plating layer of FIG. 3.

Furthermore from the comparison between FIG. 1 and FIG. 3, the following distinctions are noted between the layer structures of FIG. 2 and FIG. 4.

In the inventive hot-dip zinc plating layer, Fe is present except in the top surface region, while the middle region of the comparative hot-dip zinc plating layer is free of Fe.

In the inventive hot-zip zinc plating layer the Zn concentration and Al concentration gradually increases and decreases, respectively, in the direction from the steel to the top surface of the Zn plating layer. In the comparative hot-zip zinc plating layer no such tendency as above is found, but the Al concentration drastically decreases, keeps an almost constant level and then increases, and the Zn concentration drastically increases, keeps an almost constant level and then decreases. In both plating layers, sharp small peaks indicate the noises.

The thin stripe layer shown in FIG. 3 has the peak Al concentration indicated in FIG. 4 by the symbol $P_1$.

Figure 5:
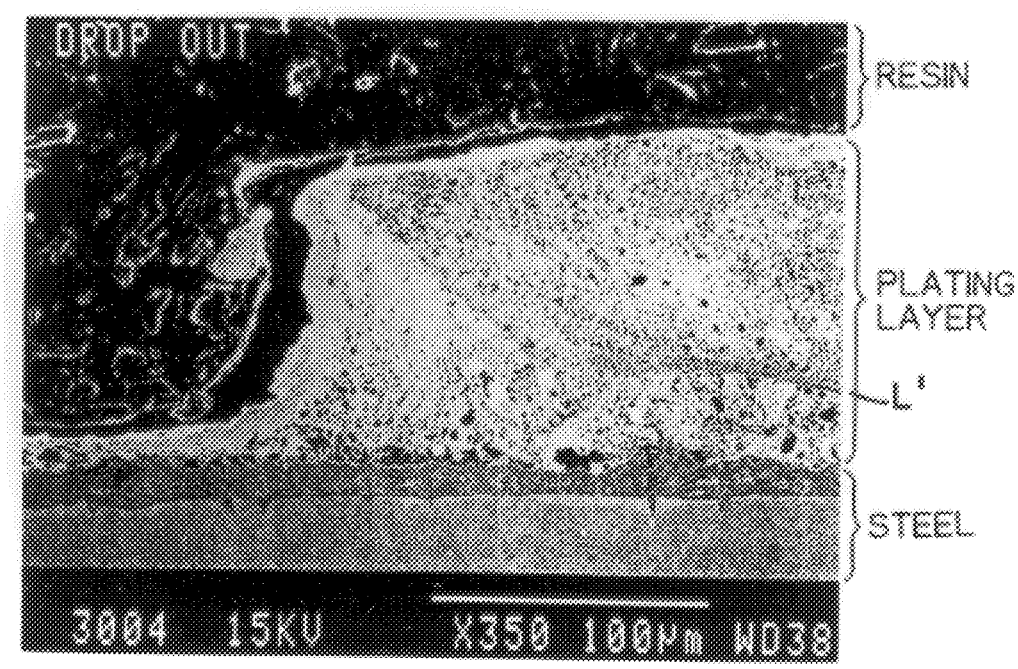
FIG. 5 is an electron microscope photograph of a hot-dip zinc plating layer, which is locally extremely thin (No. 9 of Table 1) at a magnification of 350.
Figure 6:
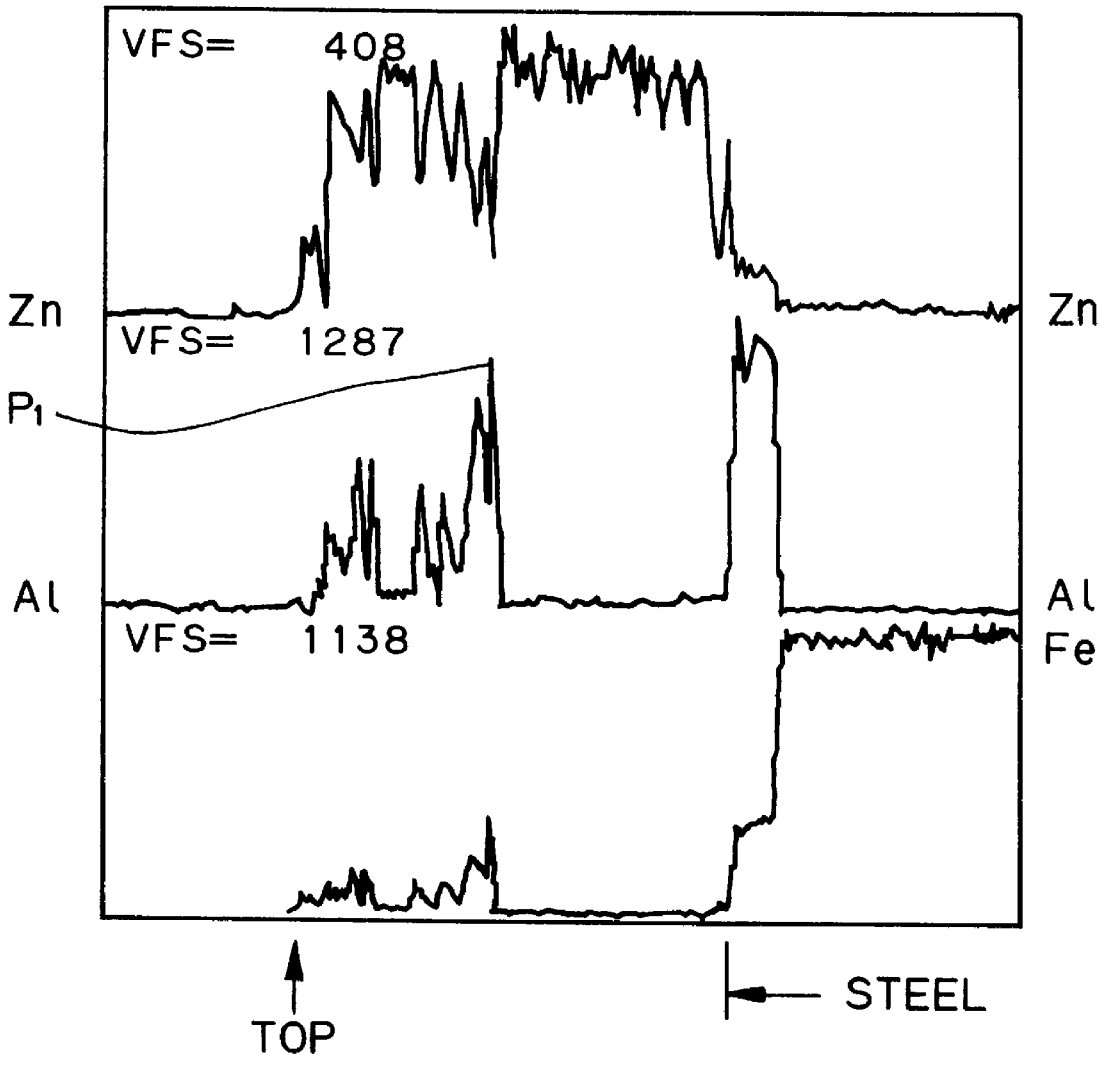
FIG. 6 is an X-ray microscope analytical chart of the hot-dip zinc plating layer of FIG. 5.

In the comparative plating layer, whose thickness is locally extremely thin, the change in Al, Zn and Fe concentrations as shown in FIG. 6 is similar to FIG. 4. An apparent layer indicated in FIG. 5 by the symbol L' corresponds to the Al concentration peak $P_1$ shown in FIG. 6.

The present invention is hereinafter described by way of examples.

EXAMPLES

Steel sheets were bent and welded to form an article shape, and the so-produced articles were subjected to conventional pre-treatment in the conventional hot-dip zinc galvanizing of a sheet, which comprises degreasing, pickling, and pre-fluxing. Subsequently, the steel sheets were subjected to hot-dip zinc plating under the inventive condition, a condition outside the inventive range and the conventional condition.

Test samples were then prepared to compare the appearance and corrosion-resistance. The test samples for evaluating appearance had dimensions ranging from 50 mm in width/300 mm in length to 1 m in width/5 m in length. The appearance evaluation was made by the naked eye taking the conventional hot-dip zinc plating coating as the standard criterion. The degree of commercial value was then judged. That is, ○ mark indicates that the samples have commercial value in line with conventional hot-dip zinc plating coating. The x mark indicates that appearance failure was generated. In this case, the form of appearance failure is recorded.

The test samples for corrosion-resistance evaluation were cut into a size 50 mm in width and 100 mm in length, so as to avoid inclusion into the evaluation of the difference in size factor which exerts an influence upon the corrosion-resistance. The surface area of the test samples was masked with paint except for the portion for the corrosion-resistance evaluation. The test samples were then subjected to the salt-water spraying test stipulated under JIS-Z-2371 in a corrosion-accelerating mode. Corrosion weight-loss ($g/m^2$) after 240 hours of test was measured. The exposure time to the salt water spray was set at 240 hours, because red rust generated on the samples prepared by the conventional method and, hence, judgment was made when the salt spray test was ended.

In addition, the time until generation of red rust on the samples was measured.

Upon comparing the corrosion-resistance of the test samples with one another, the multiplying coefficient of corrosion-resistance is defined as below to numerically evaluate the corrosion-resistance.

The corrosion-resistance multiplying coefficient-(the red-rust generation time of inventive product/the red-rust generation time of conventional hot-dip zinc galvanized sheet) ×(average coating-thickness of the conventional hot-dip zinc galvanized sheet/average coating thickness of the inventive product)

In Table 1, the results of appearance evaluation are shown, and in Table 2 the results of corrosion-test are shown.

Sample Nos. 1 through 5 are produced by the inventive method. In Sample Nos. 1 through 3, the Al level in the second hot-dipping plating bath is varied. In Sample Nos. 4 and 5, the conditions of the first and second hot-dip plating bath are varied. On the other hand, Sample Nos. 6 through 13 correspond to the comparative examples, in which the plating conditions and the steel composition are varied. Sample No. 14 corresponds to a conventional example of the hot-dip zinc galvanizing of cut sheets.

Appearance failure occurs on steel having an Si content less than 0.05% by weight when the plating conditions lie outside the inventive ranges. Appearance failure does not occur on steel having an Si content greater than 0.05 % by weight even when plating conditions lie outside the inventive ranges.

In Table 2, the results of the corrosion test as described above are indicated. It is noted, however, that the corrosion-resistance multiplying coefficient is obtained with regard to the identical steel materials, on which the plating coating was applied by the inventive and comparative methods, respectively, so as to exclude any influence of difference in the steel material upon the corrosion-resistance. Also, the red-rust generating time longer than 3000 hours according to the inventive samples indicates that the mask degraded and, later, exact evaluation of red rust became impossible.

As is clear from Table 2, the inventive method and the comparative method present a great difference in the corrosion weight-loss at 240 hours after initiation of the salt-water spray test. In addition, the inventive method and the comparative method present a difference of more than five times in the multiplying coefficient which is based on the time until red-rust generation.

The ripple-form wrinkles, i.e., one form of appearance failure, indicates that a portion(s) of the plating coating swells in a linear pattern. The rough deposits indicate that the plating coating swells less than the ripple-form wrinkles but the swelling is distributed more finely than the ripple-form wrinkles. The deficient plating indicates that the plating coating locally fails, decreasing the plating thickness.

As is described hereinabove, the plating coating provided by the present invention exhibits considerably improved corrosion-resistance so that it would maintain the rust-proofing for a long period of time under severe environmental conditions. This leads not only to save such natural resources as zinc metal for the plating use and steel material, but also to reduce the maintenance cost of the plated construction.

In the plated steel construction, various steel materials, such as killed steel, rimmed and semi-killed steel, may be welded together. The present invention also provides a hot-dip zinc-alloy plated coating having improved corrosion-resistance on such steel construction.

TABLE 1

| No. | Composition of steel (Si wt %) | 1st Plating Bath temperature (°C.) | 1st Plating Dipping Time (min.) | 2nd Plating Composition of bath (Al wt %) | 2nd Plating Bath temperature (°C.) | 2nd Plating Dipping Time (min.) | Average thickness of coating (μm) | Evaluation of appearance | Form of appearance failure | Remands |
|---|---|---|---|---|---|---|---|---|---|---|
| 1 | 0.01 | 470 | 1.0 | 6.0 | 425 | 1.0 | 61 | ○ | — | Inventive |
| 2 | 0.01 | 470 | 1.0 | 7.0 | 425 | 1.0 | 57 | ○ | — | " |
| 3 | 0.01 | 470 | 1.0 | 8.0 | 425 | 1.0 | 54 | ○ | — | " |
| 4 | 0.03 | 463 | 1.5 | 5.9 | 423 | 1.0 | 62 | ○ | — | " |
| 5 | 0.03 | 481 | 1.25 | 4.8 | 423 | 0.5 | 58 | ○ | — | " |
| 6 | 0.01 | 470 | 1.0 | 6.0 | 450 | 1.0 | 81 | x | *1 | Comparative |
| 7 | 0.01 | 470 | 1.0 | 7.0 | 450 | 1.0 | 69 | x | " | " |
| 8 | 0.01 | 470 | 1.0 | 8.0 | 450 | 1.0 | 67 | x | " | " |
| 9 | 0.03 | 480 | 0.5 | 4.8 | 440 | 0.5 | 72 | x | *1 *2 | " |
| 10 | 0.03 | 440 | 1.0 | 4.8 | 423 | 0.5 | 45 | x | *3 | " |
| 11 | 0.16 | 462 | 1.5 | 5.9 | 423 | 1.0 | 86 | ○ | — | " |
| 12 | 0.20 | 445 | 2.5 | 4.8 | 440 | 1.0 | 107 | ○ | — | " |
| 13 | 0.20 | 454 | 2.5 | 5.9 | 423 | 1.0 | 127 | ○ | — | " |
| 14 | 0.01 | 470 | 1.0 | — | — | — | 70 | ○ | — | Conventional |

*1 - ripple form wrinkle, *2 - deficient plating, *3 - rough deposit

TABLE 2

| No. | Composition of steel (Si wt %) | 1st Plating Bath temperature (°C.) | 1st Plating Dipping Time (min.) | 2nd Plating Composition of bath (Al. wt %) | 2nd Plating Bath temperature (°C.) | 2nd Plating Dipping Time (min.) | Average thickness of coating (μm) | Corrosion weight loss at 240 hr ($g/m^2$) | Time until red rust generation (hr) | Multiplying coefficient formula (1) |
|---|---|---|---|---|---|---|---|---|---|---|
| 15 | | 472 | 1.25 | 5.9 | 422 | 0.75 | 78 | 45.9 | >3,000 | |
| | 0.01 | | | | | | | | | >10 |
| 16 | | 480 | 0.83 | — | — | — | 67 | 280.9 | 240 | |
| 17 | | 480 | 1.0 | 5.9 | 422 | 1.0 | 64 | 59.0 | >3,000 | |
| | 0.01 | | | | | | | | | >13 |
| 18 | | 481 | 0.83 | — | — | — | 70 | 279.8 | 240 | |
| 19 | | 467 | 1.0 | 5.9 | 424 | 0.75 | 58 | 42.5 | >3,000 | |
| | 0.01 | | | | | | | | | >16 |
| 20 | | 468 | 1.67 | — | — | — | 77 | 303.8 | 240 | |
| 21 | | 454 | 2.5 | 5.9 | 423 | 1.0 | 127 | 27.7 | >3,000 | |
| | 0.20 | | | | | | | | | >8 |
| 22 | | 464 | 1.17 | — | — | — | 87 | 129.6 | 240 | |

I claim:

1. A hot-dip zinc plated steel, comprising:

a rimmed steel having an Si content of less than 0.05% by weight, a C content of 0.3% by weight or less and a Mn content of 0.50% by weight or less; and, a hot-dip zinc plating layer formed on a surface of the steel and consisting of from 5 to 30% by weight of Al, not more than 20% by weight of Fe, the balance being Zn and unavoidable impurities, and in which Zn, Al and Fe are present essentially in the entire thickness of the layer, the Zn content is lowest near the surface of the steel and is highest at the surface of the layer and the Al content is highest near the surface of the steel and lowest at the surface of the layer;

said hot-dip zinc plated steel being formed by a successive two-stage hot-dip galvanizing, wherein:

in a first stage hot-dip zinc plating step, a plating bath consists of zinc of 99.7% purity by weight or more and 0.05% by weight or less of Al, and has a temperature of from about 463° C. to about 481° C. and wherein a dipping time of the steel in the plating bath is from 1 minute to 1.5 minutes; and, in a second stage hot-dip zinc plating step, a plating bath consists of zinc of 99.7% purity by weight or more and from 2 to 10% by weight of Al, and has a temperature of from about 422° C. to about 425° C., and wherein a dipping time of the steel in the plating bath is from 0.5 minute to 1.5 minutes.

2. A hot-dip zinc plated steel according to claim 1, wherein the Al content of the second zinc bath is from 4 to 8% by weight.

3. A hot-dip zinc plated steel according to claim 1, wherein the hot-dip zinc plating layer thickness is from 50 to 100 μm.

* * * * *